US009155434B2

(12) United States Patent
Cho

(10) Patent No.: US 9,155,434 B2
(45) Date of Patent: Oct. 13, 2015

(54) DEVICE FOR CONNECTING VACUUM CLEANER BAG

(76) Inventor: Hyoung-Kwon Cho, Jeonju-si (KR)

( * ) Notice: Subject to any disclaimer, the term of this patent is extended or adjusted under 35 U.S.C. 154(b) by 22 days.

(21) Appl. No.: 14/119,879

(22) PCT Filed: Jun. 12, 2012

(86) PCT No.: PCT/KR2012/004634

§ 371 (c)(1),
(2), (4) Date: Nov. 24, 2013

(87) PCT Pub. No.: WO2012/173375

PCT Pub. Date: Dec. 20, 2012

(65) Prior Publication Data

US 2014/0093301 A1 Apr. 3, 2014

(30) Foreign Application Priority Data

Jun. 15, 2011 (KR) ..... 10-2011-0057999

(51) Int. Cl.
*A47L 9/14* (2006.01)
*A47L 9/16* (2006.01)

(52) U.S. Cl.
CPC ..... *A47L 9/1427* (2013.01); *A47L 9/1418* (2013.01); *A47L 9/1683* (2013.01); *Y10T 403/18* (2015.01)

(58) Field of Classification Search
CPC . B01D 46/0057; B01D 46/0091; B01D 46/24
USPC ..... 55/356, 357, 378, 478, 480, DIG. 3; 15/347
See application file for complete search history.

(56) References Cited

U.S. PATENT DOCUMENTS

| | | | | |
|---|---|---|---|---|
| 4,014,672 | A * | 3/1977 | Jansson | 55/357 |
| 4,749,391 | A * | 6/1988 | DeMarco | 55/367 |
| 5,507,859 | A * | 4/1996 | Kaiser | 95/273 |
| 5,704,956 | A * | 1/1998 | Loveless et al. | 55/305 |
| 5,776,211 | A * | 7/1998 | Jacob | 55/356 |
| 5,964,909 | A * | 10/1999 | Brunner | 55/377 |
| 7,018,438 | B2 * | 3/2006 | Duggan | 55/418 |
| 7,201,785 | B2 * | 4/2007 | Lin | 55/356 |
| 8,029,584 | B2 * | 10/2011 | Castronovo | 55/283 |
| 8,695,158 | B2 * | 4/2014 | Cheng | 15/352 |
| 2004/0035092 | A1 * | 2/2004 | Wang | 55/356 |
| 2011/0203238 | A1 * | 8/2011 | Witter et al. | 55/356 |

FOREIGN PATENT DOCUMENTS

| | | |
|---|---|---|
| JP | 61-067650 | 4/1986 |
| JP | 61-126968 | 6/1986 |
| JP | 63-062061 | 3/1988 |
| JP | 05-065718 | 3/1993 |

OTHER PUBLICATIONS

International Search Report of International Application No. PCT/KR2012/004634, dated Dec. 26, 2012.

* cited by examiner

*Primary Examiner* — Duane Smith
*Assistant Examiner* — Minh-Chau Pham
(74) *Attorney, Agent, or Firm* — Kile Park Reed & Houtteman PLLC

(57) ABSTRACT

According to the present invention, a device for connecting a vacuum cleaner bag is capable of using a regular garbage bag as a bag for collecting dust and garbage inside, and conveniently mounting and removing the bag on a lower side of a dust collecting device.

4 Claims, 4 Drawing Sheets

DEVICE FOR CONNECTING VACUUM CLEANER BAG

TECHNICAL FIELD

The present invention relates, in general, to a device for connecting a bag receiving dust and debris, which is mounted to a lower portion of a cyclone dust collecting device of a vacuum cleaner to receive dust and debris and, more particularly, to a device for connecting a vacuum cleaner bag, which is intended to mount a bag collecting dust and debris therein to a lower portion of a dust collecting device, and which includes an upper cover having a shape of a cylinder that vertically communicates at an upper portion thereof with the lower portion of the dust collecting device and is open at a lower portion thereof, with an insertion groove being formed vertically in a lower edge of the upper cover to define an inner wall and an outer wall, a lower cover having a shape of a cylinder that is open at an upper portion thereof, a sidewall of the lower cover being inserted into the insertion groove in such a way that a lower end of the inner wall of the upper cover comes into contact with a bottom in the lower cover, and a locking means locking the upper cover to the lower cover, whereby the bag is secured between the inner wall of the upper cover and the sidewall of the lower cover while covering an upper edge of the sidewall of the lower cover.

This application is based upon and claims the benefit of priority from Korean Patent Appl. No. 10-2011-0057999, the entire contents of which are incorporated herein by reference.

BACKGROUND ART

Generally, a vacuum cleaner is intended to forcibly suck dust and other contaminants along with air from outside the device with a suction force using a difference between internal pressure and external pressure of a body, which is generated as a motor having an impeller mounted on its rotating shaft rotates at high speed, thereby cleaning an area of unwanted dirt, dust and debris. Such a vacuum cleaner is provided with a dust collecting device to remove debris from the sucked air and collect the debris.

As such a dust collecting device for the vacuum cleaner, a cyclone dust collecting device is widely used, in which dust and debris are introduced into a debris inlet port along with air and are rotated therein together with the air, and the debris falls downwards, and only the air is discharged through a side portion or an upper portion. The currently available vacuum cleaner using the cyclone dust collecting device has a dust bin on a lower portion of the cyclone dust collecting device to discharge the debris, thus allowing the debris collected in the dust bin to be thrown away. Alternatively, a dedicated dust bag may be used to store dust and debris therein, so that a user can throw the bag away.

However, this is problematic in that a user should open the dust bin and remove the debris from the dust bin, thus causing inconvenience, and should repeat a process of washing the dust bin with water and then drying the dust bin so as to manage it in a sanitary way, thus being very cumbersome. Further, even in the case of using the dedicated dust bag, the dedicated dust bag is disposable, so that the dust bag should be thrown away after it has been used, and besides, additional dedicated dust bags should be purchased, thus causing economic losses.

DISCLOSURE

Technical Problem

Accordingly, the present invention has been made keeping in mind the above problems occurring in the prior art, and an object of the present invention is to provide a device for connecting a vacuum cleaner bag, in which debris dropping down from a dust collecting device is received in a general garbage bag fitted into the dust bin, thus enabling a user to easily separate the bag from a vacuum cleaner and discharge it.

Technical Solution

In order to accomplish the above object, the present invention provides a device for connecting a vacuum cleaner bag, intended to mount a bag collecting dust and debris therein to a lower portion of a dust collecting device, the bag connecting device including an upper cover having a shape of a cylinder that vertically communicates at an upper portion thereof with the lower portion of the dust collecting device and is open at a lower portion thereof, with an insertion groove being formed vertically in a lower edge of the upper cover to define an inner wall and an outer wall; a lower cover having a shape of a cylinder that is open at an upper portion thereof, a sidewall of the lower cover being inserted into the insertion groove in such a way that a lower end of the inner wall of the upper cover comes into contact with a bottom of a receiving space in the lower cover; and a locking means locking the upper cover to the lower cover, whereby the bag is secured between the inner wall of the upper cover and the sidewall of the lower cover while covering an upper edge of the sidewall of the lower cover.

Preferably, the device for connecting the vacuum cleaner bag may further include a packing provided in the insertion groove to seal a gap between the upper cover and the lower cover and thereby prevent fine dust from being discharged.

Further, the locking means may preferably use a detachable clamp.

Figure 1:
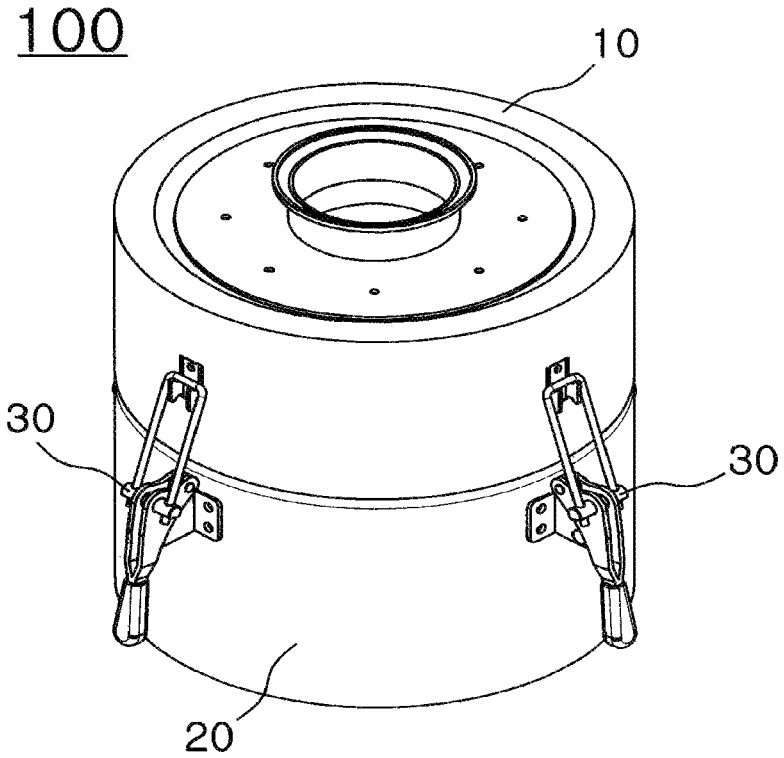
FIG. 1 is a perspective view showing a device for connecting a bag, according to the present invention.

| <Description of the Reference Numerals in the Drawings> | |
|---|---|
| 100: bag connecting device | A: bag |
| B: receiving space | 1: dust collecting device |
| 10: upper cover or container | 11: insertion groove |
| 12: inner wall | 13: outer wall |
| 20: lower cover or container | 21: sidewall |
| 30: locking means | 40: packing |

MODE FOR INVENTION

Hereinafter, the present invention will be described in detail with reference to the accompanying drawings. The terminologies or words used in the description and the claims of the present invention should not be interpreted as being limited merely to common and dictionary meanings. On the contrary, they should be interpreted based on the meanings and concepts of the invention in keeping with the scope of the invention on the basis of the principle that the inventor can appropriately define the terms in order to describe the invention in the best way. Therefore, it should be understood that an embodiment described in this specification and a configuration shown in the drawings are illustrative and not restrictive, so that various modifications, additions and substitutions are possible within the purview of the invention.

According to the present invention, a device for connecting a vacuum cleaner bag is intended to mount a bag collecting dust and debris therein to a lower portion of a dust collecting device. The bag connecting device includes an upper cover 10, a lower cover 20, and a locking means 30. The upper cover 10 has a shape of a cylinder that vertically communicates at an upper portion thereof with the lower portion of the dust collecting device 1 and is open at a lower portion thereof, with an insertion groove 11 being formed vertically in a lower edge of the upper cover to define an inner wall 12 and an outer wall 13. The lower cover 20 has a shape of a cylinder that is open at an upper portion thereof, a sidewall 21 of the lower cover being inserted into the insertion groove 11 in such a way that a lower end of the inner wall 12 of the upper cover 10 comes into contact with a bottom of a receiving space B in the lower cover. The locking means 30 locks the upper cover 10 to the lower cover 20. Thereby, the bag A is secured between the inner wall 12 of the upper cover and the sidewall 21 of the lower cover while covering an upper edge of the sidewall 21 of the lower cover 20.

Further, the bag connecting device preferably includes a packing 40 that is provided in the insertion groove 11 to seal a gap between the upper cover 10 and the lower cover 20 and thereby prevent fine dust from being discharged.

Further, the locking means 30 preferably uses a detachable clamp.

Hereinafter, the configuration and operation of the device 100 for connecting the vacuum cleaner bag according to the present invention will be described in detail with reference to the accompanying drawings.

Figure 2:
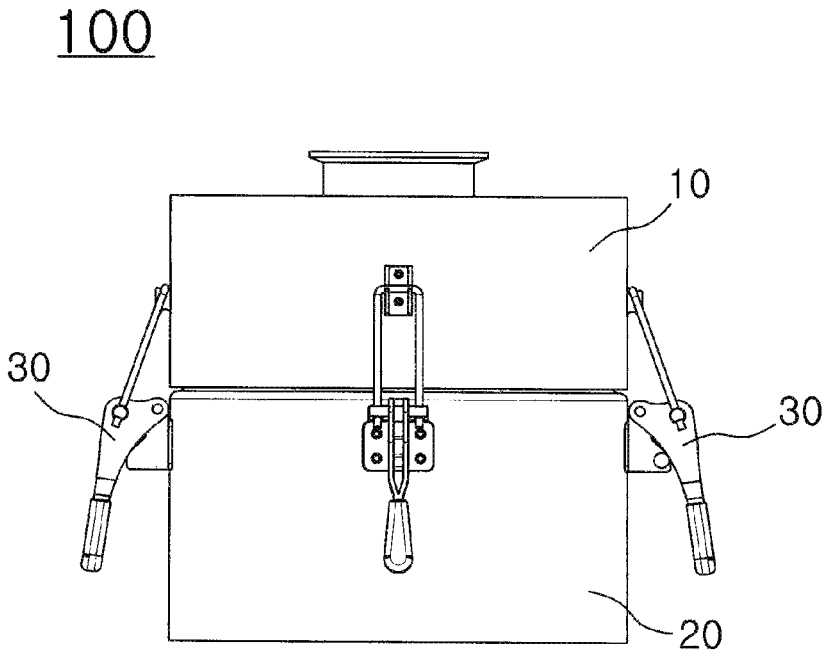
FIG. 2 is a front view showing the device for connecting the bag, according to the present invention.
Figure 3:
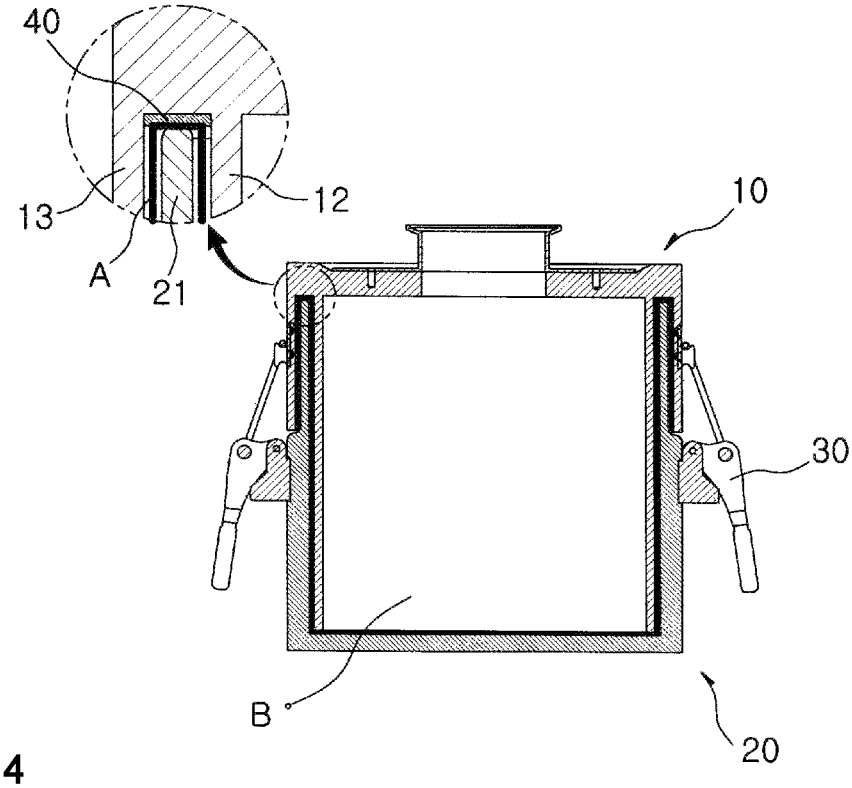
FIG. 3 is a longitudinal sectional view showing the device for connecting the bag, according to the present invention.
Figure 4:
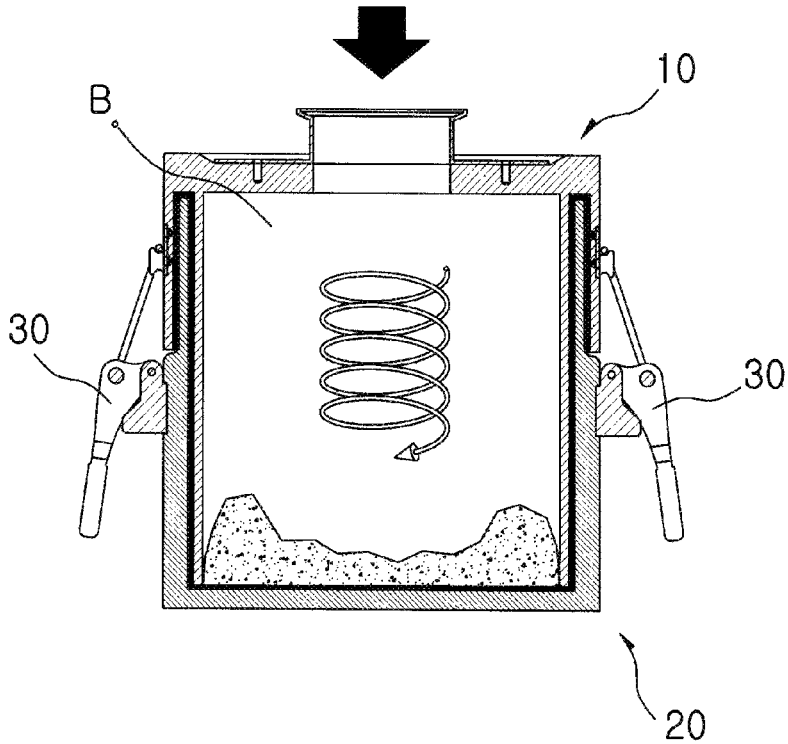
FIG. 4 is a view showing a state of collecting debris according to the present invention.
Figure 5:
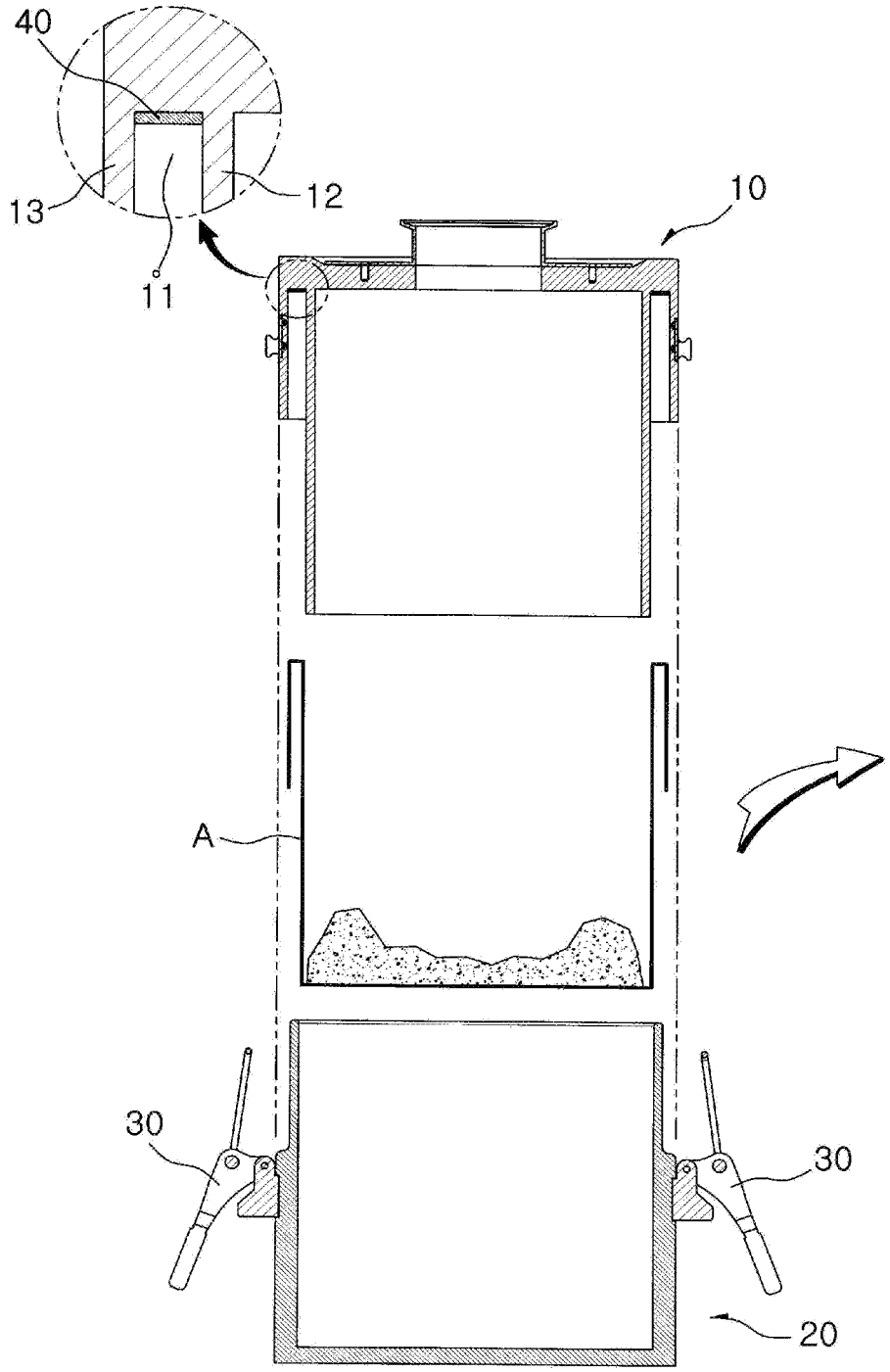
FIG. 5 is a view showing a state of discharging debris according to the present invention.
Figure 6:
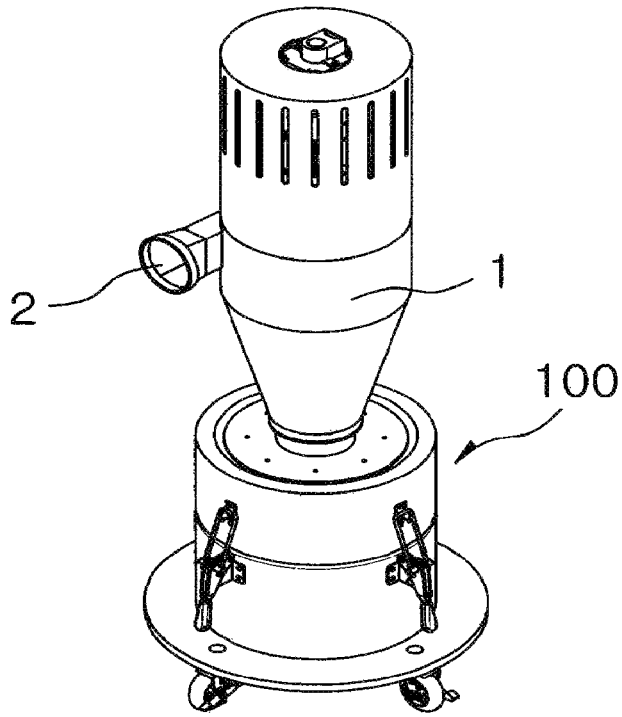
FIG. 6 is a view showing a state of using a vacuum cleaner according to the present invention.
Figure 7:
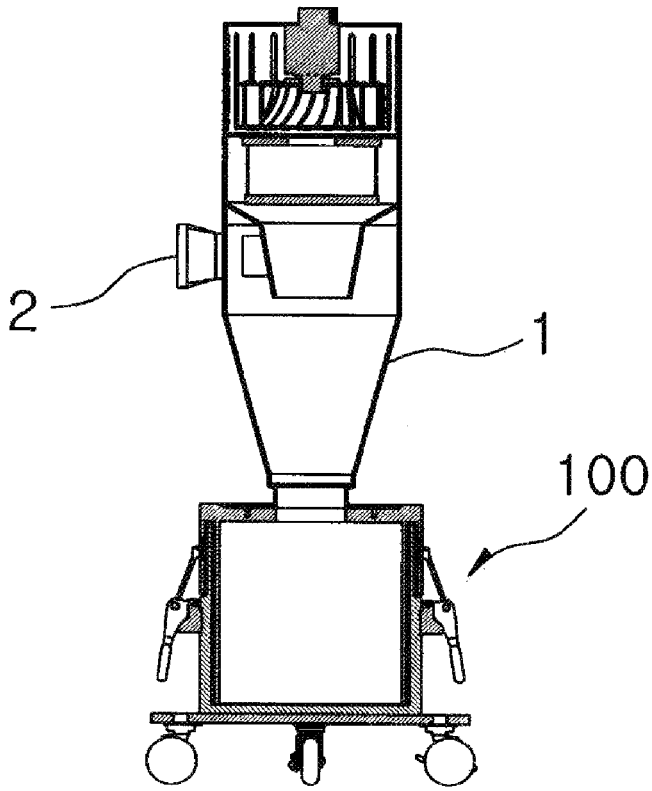
FIG. 7 is a longitudinal sectional view of FIG. 6.

FIG. 1 is a perspective view showing a device for connecting a bag, according to the present invention, FIG. 2 is a front view showing the device for connecting the bag, according to the present invention, FIG. 3 is a longitudinal sectional view showing the device for connecting the bag, according to the present invention, FIG. 4 is a view showing a state of collecting debris according to the present invention, FIG. 5 is a view showing a state of discharging debris according to the present invention, FIG. 6 is a view showing a state of using a vacuum cleaner according to the present invention, and FIG. 7 is a longitudinal sectional view of FIG. 6.

As shown in FIGS. 1 to 3, the bag connecting device 100 according to the present invention includes the upper cover 10 which has the shape of the cylinder that vertically communicates at the upper portion thereof with the lower portion of the dust collecting device 1 and is open at the lower portion thereof, with the insertion groove 11 being formed vertically in the lower edge of the upper cover to define the inner wall 12 and the outer wall 13, the lower cover 20 which has the shape of the cylinder that is open at the upper portion thereof, the sidewall 21 of the lower cover being inserted into the insertion groove 11 in such a way that the lower end of the inner wall 12 of the upper cover 10 comes into contact with the bottom of the receiving space B in the lower cover, and the locking means 30 which locks the upper cover 10 to the lower cover 20.

The dust collecting device 1 preferably uses a cyclone dust collecting device, in which dust and debris are introduced into the device along with air and are rotated therein together with the air, so that the debris falls downwards, and only the air is discharged through a side portion or an upper portion.

Preferably, the upper cover 10 has the shape of the cylinder that vertically communicates at the upper portion thereof with the lower portion of the dust collecting device 1 and is open at the lower portion thereof, with the insertion groove 11 being formed vertically in the lower edge of the upper cover to define the inner wall 12 and the outer wall 13.

Further, preferably, the lower cover 20 has the shape of the cylinder that is open at the upper portion thereof, and the sidewall 21 of the lower cover is inserted into the insertion groove 11 in such a way that the lower end of the inner wall 12 of the upper cover 10 comes into contact with the bottom of the receiving space B for receiving the debris. Preferably, an outer circumference of a portion of the sidewall 21 that is not inserted into the insertion groove 11 is aligned with an outer circumference of the outer wall 13 of the upper cover.

Further, the locking means 30 preferably uses the detachable clamp such that one side is secured to an outer portion of the outer wall 12 of the upper cover 10 while the other side is secured to an outer circumference of the sidewall 21 of the lower cover 20, thus allowing the sidewall 21 of the lower cover 20 to be inserted into and come into close contact with the insertion groove 11 of the upper cover 10. Of course, it is possible to use a latch or a fastener equipped with a spring, as the locking means. A structure of the clamp is disclosed in Korean U.M. Registration No. 20-236237, etc.

On one hand, the bag A utilizes a standard plastic garbage bag or a vinyl bag, which is widely used. Preferably, the bag A is secured between the inner wall 12 of the upper cover and the sidewall 21 of the lower cover while covering the upper edge of the sidewall 21 of the lower cover 20.

Preferably, the packing 40 is further provided in the insertion groove 11 to seal the gap between the upper cover 10 and the lower cover 20 and thereby prevent fine dust from being discharged.

As shown in FIG. 4, the dust collecting device 1 is configured such that dust and debris move from an exterior to the device 1, along with the air, by a suction force generated when the mounted motor rotates at high speed, and then they are rotated in the device along with the air, as a result of which the debris drops to the receiving space defined in the upper cover 10 and the lower cover 20 and the air is discharged through the side portion or the upper portion. If the sealing force for the receiving space is reduced, the bag does not come into close contact with the bottom of the receiving space but is swollen by the generated suction force, thus making it difficult to efficiently receive the debris.

For this purpose, the packing 40 made of silicone or synthetic resin material is preferably inserted into the insertion groove 11 of the upper cover 10, thus catching and compressing the bag A between the upper edge of the sidewall 21 of the lower cover 20 and the packing 40 and thereby improving the sealing force for the receiving space. Preferably, the lower end of the inner wall 12 of the upper cover 10 is provided to come into contact with the bottom of the receiving space B, thus supporting a side surface of the bag A, and preventing a hole from being formed in the bag A due to the impact of the debris on the side surface of the bag A by the rotated air that is generated by the dust collecting device 1.

As shown in FIG. 5, according to the present invention, the upper cover 10 and the lower cover 20 are detachably coupled to each other by the locking means 30 provided on the outer circumferences of the upper and lower covers 10 and 20.

When a user desires to replace the bag A with a new one, the upper cover 10 and the lower cover 20 are separated from each other using the locking means 30, thus allowing the bag A containing the debris to be effectively taken out from the lower cover 20 and then discharged.

Further, as shown in FIGS. 6 and 7, the bag connecting device 100 according to the present invention is applied to a vacuum cleaner having a motor, a fan and a filter. Specifically, the vacuum cleaner may include a debris inlet port 2, a cyclone dust collecting device 1 configured to introduce dust and debris into the debris inlet port 2 along with air and rotate them along with air, thus dropping the debris downwards and discharging only the air through the side portion or upper portion of the cyclone dust collecting device 1, and a guide tube directed to a place where a user desires to clean. In this case, the bag connecting device 100 according to the present invention is mounted to the lower portion of the cyclone dust collecting device 1 in such a way as to vertically communicate therewith. A caster may be further provided on the bottom of the lower cover 20 to allow the bag connecting device 100 to move freely.

As such, the present invention pertains to the device 100 for connecting the vacuum cleaner bag, including the upper cover 10 having the shape of the cylinder that vertically communicates at the upper portion thereof with the lower portion of the dust collecting device 1 and is open at the lower portion thereof, with the insertion groove 11 being formed vertically in the lower edge of the upper cover 10 to define the inner wall 12 and the outer wall 13, the lower cover 20 having the shape of the cylinder that is open at the upper portion thereof, the sidewall 21 of the lower cover being inserted into the insertion groove 11 in such a way that the lower end of the inner wall 12 of the upper cover 10 comes into contact with the bottom of the receiving space B in the lower cover, and the locking means 30 locking the upper cover 10 to the lower cover 20, so that the bag A is secured between the inner wall 12 of the upper cover and the sidewall 21 of the lower cover while covering the upper edge of the sidewall 21 of the lower cover 20. Although the preferred embodiment of the present invention has been disclosed for illustrative purposes, those skilled in the art will appreciate that various modifications, additions and substitutions are possible, without departing from the scope and spirit of the invention as disclosed in the accompanying claims.

Industrial Applicability

As described above, the present invention provides a device for connecting a vacuum cleaner bag, including an upper cover having a shape of a cylinder that vertically communicates at an upper portion thereof with the lower portion of the dust collecting device and is open at a lower portion thereof, with an insertion groove being formed vertically in a lower edge of the upper cover to define an inner wall and an outer wall, a lower cover having a shape of a cylinder that is open at an upper portion thereof, a sidewall of the lower cover being inserted into the insertion groove in such a way that a lower end of the inner wall of the upper cover comes into contact with a bottom of a receiving space in the lower cover, and a locking means locking the upper cover to the lower cover, so that the bag is secured between the inner wall of the upper cover and the sidewall of the lower cover while covering an upper edge of the sidewall of the lower cover, thus allowing debris dropping down from the dust collecting device to be received in a general garbage bag fitted into a dust bin, and thereby enabling a user to easily separate the bag from a vacuum cleaner and discharge it.

The invention claimed is:

1. A device for connecting a vacuum cleaner bag, intended to mount a bag collecting dust and debris therein to a lower portion of a dust collecting device, the device for connecting a vacuum cleaner bag comprising:

an upper cover having a shape of a cylinder that vertically communicates at an upper portion thereof with the lower portion of the dust collecting device and is open at a lower portion thereof, with an insertion groove being formed vertically in a lower edge of the upper container to define an inner wall and an outer wall;

a lower container having a shape of a cylinder that is open at an upper portion thereof, a sidewall of the lower container being inserted into the insertion groove in such a way that a lower end of the inner wall of the upper cover extends within the lower container and is operable to extend the vacuum cleaner bag within the lower container until the vacuum cleaner bag comes into contact with a bottom of a receiving space in the lower container; and locking means locking the upper cover to the lower container, whereby the vacuum cleaner bag is operably secured between the inner wall of the upper cover and the sidewall of the lower container while covering an upper edge of the sidewall of the lower container.

2. The device for connecting a vacuum cleaner bag of claim 1, further comprising:

a packing provided in the insertion groove to seal a gap between the upper cover and the lower container and thereby prevent fine dust from being discharged.

3. The device for connecting a vacuum cleaner bag of claim 1, wherein the locking means operably includes a detachable clamp.

4. The device for connecting a vacuum cleaner bag of claim 1, wherein the insertion groove is U-shaped in a cross-sectional view thereof.

* * * * *